United States Patent [19]

Clayton

[11] 4,189,305

[45] Feb. 19, 1980

[54] SMOKELESS FIRE KINDLING DEVICE

[75] Inventor: William J. Clayton, Fairport, N.Y.

[73] Assignee: Mobil Oil Corporation, New York, N.Y.

[21] Appl. No.: 928,342

[22] Filed: Jul. 27, 1978

Related U.S. Application Data

[63] Continuation of Ser. No. 769,644, Feb. 17, 1977, abandoned.

[51] Int. Cl.[2] ..... C10L 11/00

[52] U.S. Cl. ..... 44/41; 44/34; 44/38

[58] Field of Search ..... 44/1 E, 6, 7.5, 10 B, 44/34, 38, 40, 41

[56] References Cited

U.S. PATENT DOCUMENTS

| | | | |
|---|---|---|---|
| 2,094,661 | 10/1937 | Macleay et al. | 44/41 |
| 3,279,900 | 10/1966 | Naples | 44/41 X |

*Primary Examiner*—Carl Dees

*Attorney, Agent, or Firm*—Charles A. Huggett; Ronald J. Cier

[57] ABSTRACT

A clean, substantially smokeless, non-volatile, normally solid product for the ignition of fires, such as charcoal or wood fires, for cooking, campsites, home fireplaces, and so forth. The device comprises a shaped intimate mixture of a wax (e.g. hydrocarbon) and a combustible cellulosic material in particulate form associated with a lighting means of combustible material, said mixture comprising the wax in major proportion by weight, based on the weight of the wax and the cellulosic material.

8 Claims, 4 Drawing Figures

30
33
25
26
32
10
10
34

12
11
10

SMOKELESS FIRE KINDLING DEVICE

This is a continuation, of application Ser. No. 769,644, filed Feb. 17, 1977 and now abandoned.

BACKGROUND OF THE INVENTION

1. Field of the Invention

This invention relates to a device for facilitating the kindling of fires, such as charcoal or wood fires. More particularly, it relates to a relatively safe, substantially smokeless, non-volatile product for the kindling of outdoor cooking first in a combustible medium, such as charcoal briquettes.

2. Description of the Prior Art

Camping and outdoor cooking, especially backyard barbeques and cookouts, enjoy a high degree of popularity which is rapidly increasing as more and more people are introduced to the joy of outdoor living and the gratifying experience of open-air cooking. This outdoor cooking experience requires the use of a suitable cooking fire and, desirably, such a fire should be easily ignited and maintained.

Cooking fires are, of course, very common things and methods of starting them date from antiquity. Given the requisite skill and sufficient time, any person can satisfactorily build and ignite a cooking fire. But in many instances people today have neither the time, the patience nor the proficiency required to gather firewood and kindling, properly arrange and ignite them and then build this into a fire of suitable proportions. So, oftentimes, other materials are used as sources of initial combustion, which materials are more convenient and better suited to ignite charcoal, charcoal briquettes, artificial fireplace logs, etc.

One simple method is to crumple balls of paper, such as newsprint, pile the briquettes or whatever other material is being used around and on top of the crumpled paper and light the paper with a match. Hopefully, the burning paper will ignite some of the briquettes and they in turn will ignite the others. However, in practice, the paper may burn too quickly, not lasting long enough to raise the temperature of the briquettes to the ignition point. A slightly more sophisticated approach, and one which provides more reliable results, is to first build a fire with small pieces of kindling wood and then place the briquettes on top of the burning kindling. The wood lasts longer than burning paper and will suitably ignite the briquettes before burning out. Building such a fire, however, requires at least a modicum of skill and practice on the part of the practitioner and may entirely negate the convenience factor of using wood substitutes such as charcoal briquettes.

Another approach has been to use flammable liquid fuels, primarily petroleum naphtha, which are allowed to permeate the briquettes or other combustible material before ignition. Upon ignition, such liquid fuels efficiently heat the briquettes or other material to ignition temperature and cause them to begin burning in a suitably even manner. Petroleum naphtha, however, has some very serious drawbacks in spite of its wide acceptance. Besides being convenient to use, it presents a safety hazard and is an unpleasant substance to handle. Being a highly volatile and extremely flammable liquid, it presents an explosion and fire hazard during storage and use. Additionally, because of its volatility, there is a rapid rate of evaporation and loss during use and before lighting.

Through the years various other materials have been used to kindle outdoor fires. Thus, U.S. Pat. No. 617,424 (Pflaum, 1899) discloses a sheet of paper coated with wax which is useful for this purpose, and U.S. Pat. No. 1,113,478 (Phillips, 1914) teaches a plurality of tubes dipped in wax and having ends which are cut into a plurality of strips. Similarly, U.S. Pat. Nos. 3,297,420 (Klink, et al); 3,367,757 (Church) and 3,395,003 (Alexander) present variations on this same theme. Also, U.S. Pat. Nos. 2,548,379 (Lammerson), 2,965,096 (Barton), 3,317,290 (Gentry), and 3,385,282 (Lloyd) disclose various disposable cooking units which typically contain the charcoal and a fire-starter, usually wax-impregnated paper, right within the unit. The entire package is ignited and consumed by the fire or, in some cases, the unburned container is thrown away after use.

U.S. Pat. No. 2,007,694 (Rutherford) discloses a different type of lighter which is essentially a block of wood pulp or other vegetable fibers which is allowed to absorb melted wax until it becomes saturated and then is compressed to squeeze out the excess wax. The wax-saturated block then has slots cut into it to facilitate air passage during burning. In use the block is ignited to produce a large flame which will effectively ignite coal, wood or other fuel in a stove or furnace. U.S. Pat. No. 3,279,900 (Naples) discloses a disposable package consisting of a container of combustible material which encloses a quantity of charcoal briquettes and an ignition device. The ignition device is a wood fiber base saturated with paraffin wax, which may constitute ten to twenty percent of the total weight of the device, and in which holes have been placed to provide air drafts for the fire. The entire package is placed in a suitable enclosure, such as a barbecue grill, and the outer container ignited. The flame is communicated to the ignition device and from thence to the adjacent briquettes.

A device of a different nature, which at one time was used by soldiers in the field to heat canned rations, consisted essentially of a box which was coated with a wax having a relatively high melting point and filled with a mixture of lower melting wax and wood flour. In use the flaps of the box were lit and the fire thus communicated to the wax-wood flour composition. The higher melting wax served the dual purpose of waterproofing the box and preventing melted wax from escaping through the walls while the food was heated above the box.

SUMMARY OF THE INVENTION

There is disclosed herein a non-volatile, solid, smokeless device for the relatively safe and convenient ignition of fires in combustible materials, such as charcoal, charcoal briquettes, fireplace logs, wood and so forth. The device comprises a shaped composition of wax in intimate mixture with a combustible cellulosic material and associated with an integral lighting means of combustible material attached to only a portion of the surface area of said shaped composition, said mixture comprising a major amount by weight of the wax based on the wax and cellulosic material. More specifically, the lighting means is attached to a minor portion of the surface area of the shaped composition. In one preferred embodiment, the lighting means comprises a film of wax-impregnated combustible sheet material. In embodiments in which the shaped solid composition is in the form of a cube, a rectangle, etc., the lighting means in the form of a film is attached to only one of the surfaces. In use, the device is placed on top of or between the pieces of charcoal briquettes, or whatever combustible is to be burned, the lighting means is lit and it in turn communicates the flame to the hydrocarbon wax. Some of the wax melts and soaks into the briquettes and the remaining wax is held in place by the cellulosic material. As the wax burns it raises the temperature of the briquettes to the ignition point, thereby igniting them and providing an even-burning fire for cooking or heating purposes, or any other desired end use.

Such a device, comprising a non-volatile solid, is safe to store and transport, easy to pack and carry, and presents no substantial explosion hazard. It is clean to handle, burns without smoking or creating an overly large flame and has no unpleasant odor. In addition, it is desirably waterproof, and imparts no extraneous taste to food cooked over it. If desired, pleasing color and odor elements may be incorporated into the device by adding suitable coloring and/or scenting agents to the hydrocarbon wax during the blending operation.

The integral lighting means serves as a convenient means for igniting the device. Once lit, the wax is held in place by the cellulosic material, which serves as a binding agent. Positioning of the burning wax at or near the top of the combustible material is an important factor in its operation. When the wax is allowed to melt entirely and run free, which would happen except for the binder, it has a tendency to run off of the material it is meant to ignite and drop to the bottom of the grill (or fireplace or whatever) where it will not be able to get sufficient oxygen to support efficient combustion. The end result would be a lot of smoke.

Unlike prior art fire starters, as typified by the disclosures contained in U.S. Pat. Nos. 2,007,694 and 3,279,900, wherein the relatively minor proportion of wax serves only to bind the burning wood fibers together, the present device is based upon burning wax and uses the cellulosic material to hold the wax in place long enough to allow it to soak into the combustible material. By allowing a controlled portion of the wax to melt and permeate the hot combustible material (e.g. the charcoal briquette), the combustible itself becomes a part of the starter.

DESCRIPTION OF THE PREFERRED EMBODIMENTS

Figures 1, 3:
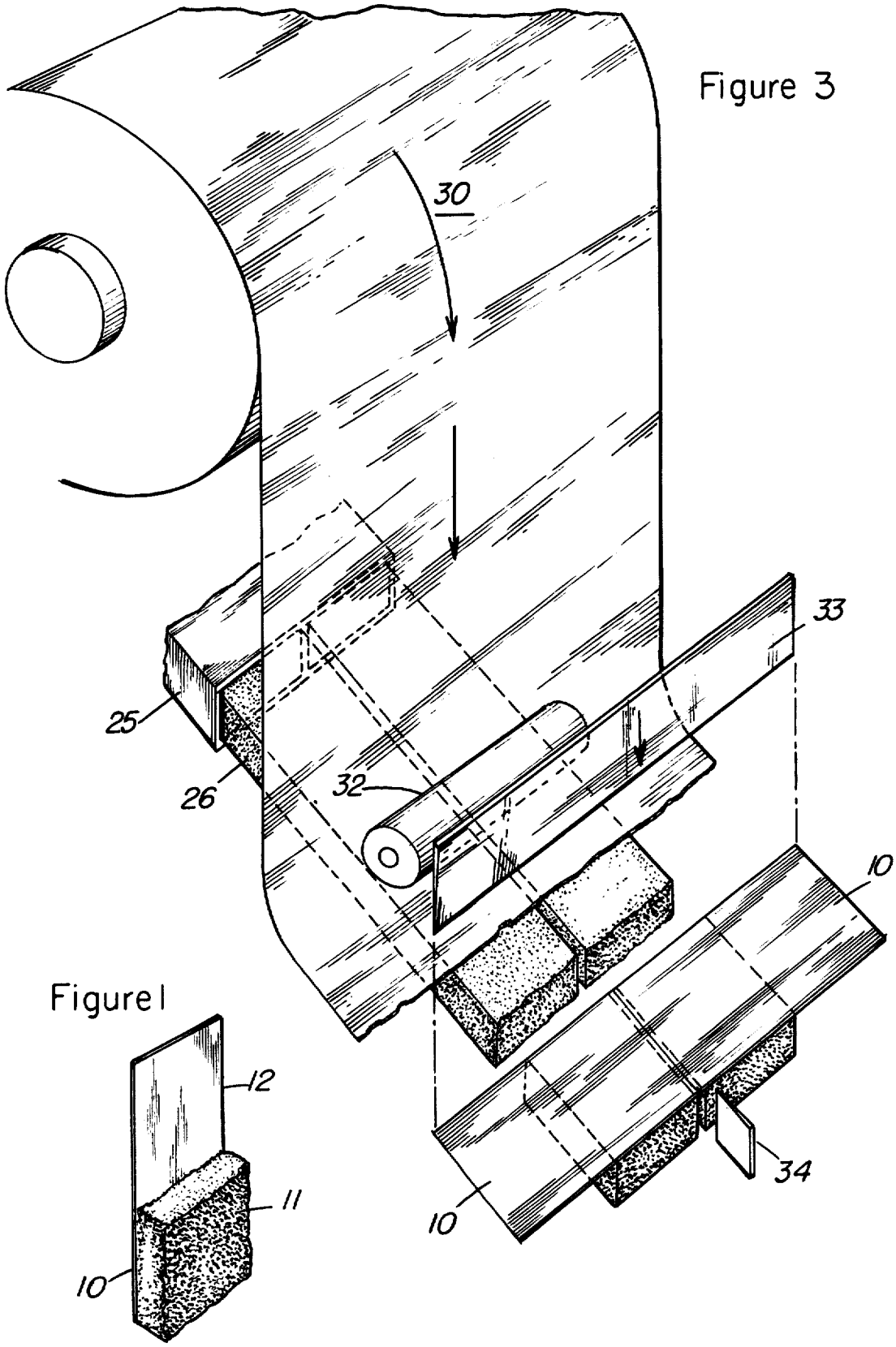
FIG. 1 is a perspective view of an embodiment of a fire kindling device.
FIG. 3 is a diagrammatic representation showing the attachment of the lighting means to the extruded body and the cutting of individual devices modeled after the embodiment of FIG. 1.

With reference to FIG. 1 of the drawings, the present invention relates to a fire kindling device 10 which is comprised of body 11 with integral lighting means 12 attached to one side thereof. The body 11 is further comprised of hydrocarbon wax in intimate mixture with a cellulosic binding material, and lighting means 12 is comprised of a combustible sheet material which may or may not be impregnated with wax, depending upon the composition and burning characteristics of said combustible sheet material.

In an embodiment the body 11 is in the form of a three dimensional solid block having a width of 1 cm to 6 cm, a height of 1 cm to 6 cm and a thickness of 0.5 cm to 3 cm. Preferred dimensions are 2 cm to 3 cm wide, by 3 cm to 4 cm high, by 1 cm to 1.5 cm thick. The lighting means 12 is preferably the same width as the body 11 and extends beyond the body 11 from 1 cm to 6 cm, and more specifically, the lighting means 12 extends from 1 cm to 3 cm beyond the body 11.

The body 11 is comprised of the wax in major amount, based on the weight of the wax and the binder and, preferably, from in excess of 50% and up to 90% by weight, in admixture with a cellulosic binding material, and more specifically from in excess of 50% up to 80% by weight of wax and 20% to less than 50% of cellulosic binder. The hydrocarbon wax is most desirably that solid crystalline hydrocarbon mixture derived from the paraffin distillate portion of crude petroleum, but it may be any similar material, natural or synthetic, which is commonly classified as wax. The cellulosic material may be any fibrous, cellulose or cellulose-like material or derivative thereof. Examples of suitable materials include vegetable fibers such as wood pulp, sawdust, cotton, paper pulp, and so forth. Most preferred are wood fibers, either in the form of pulp or of sawdust. The lighting means 12 is comprised of a combustible sheet material, preferably paper but other sheet materials such as combustible woven fabric and combustible non-woven fabric may also be used. Lighting means 12 may be coated with hydrocarbon wax, which may be the self same wax as was used in body 11.

Figure 2:
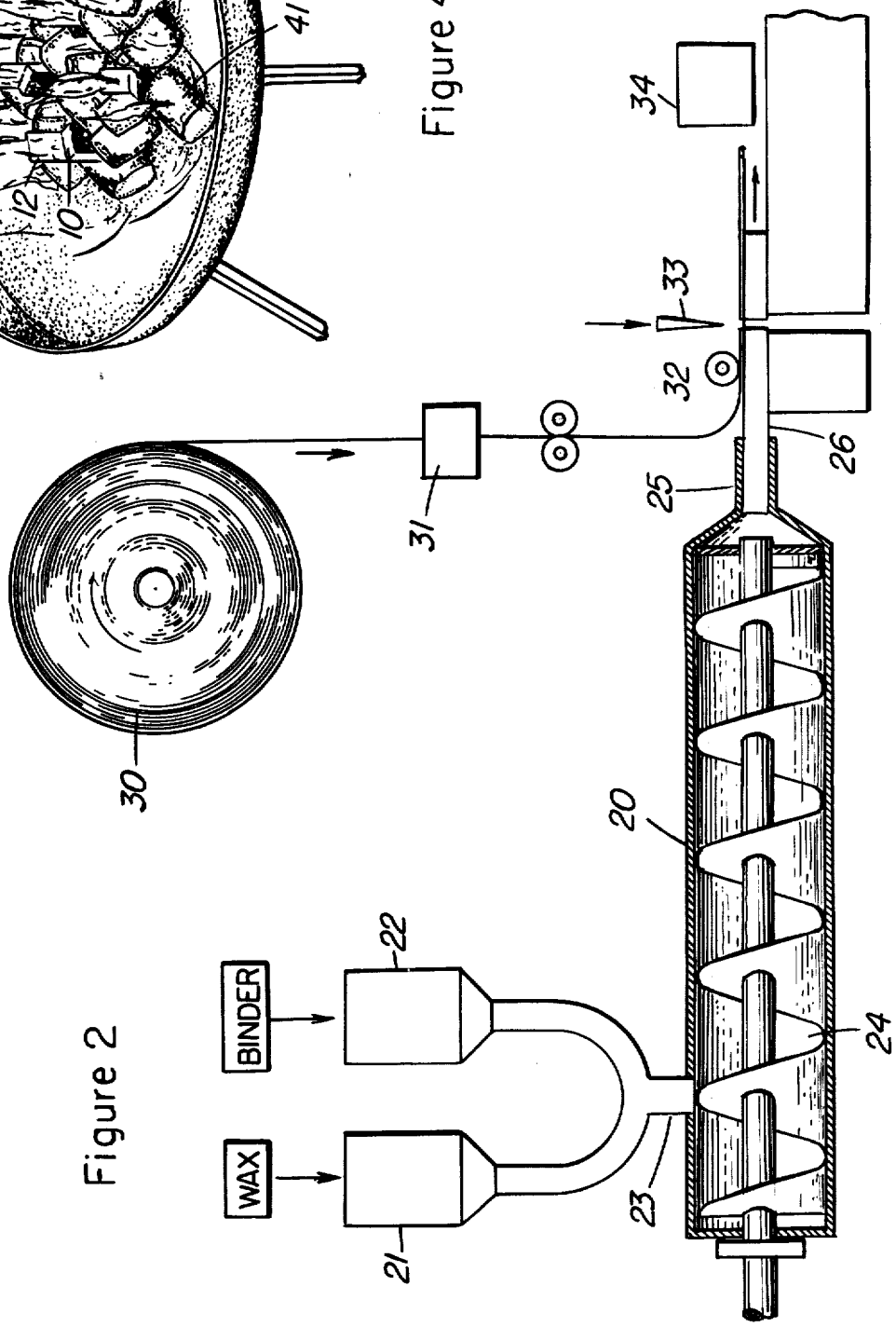
FIG. 2 is a diagrammatic representation, in cross-section, of a process for the manufacture of the device of this invention.

A method of producing the subject matter of this invention can be visualized by reference to FIGS. 2 and 3 of the drawings, in which a system adaptable to high-speed processing is depicted. Briefly, the wax, which had previously been reduced to small particles, is placed in vat 21 and the binder material is placed in vat 22. Using the appropriate valving (not shown) these materials are admitted together in the proper, predetermined ratio at entry port 23 of heated screw pump 20. Alternately, they may be measured and mixed by means external to pump 20 and introduced at port 23 from a suitable single source instead of vats 21 and 22. Once within pump 20 the materials are heated to a temperature below the melting temperature of the wax, while being intimately mixed and moved forward by screw 24. If, for instance, the wax melts at 60° C. (140° F.), a suitable mixing temperature would be 49° C. (120° F.).

Attached to the exit end of pump 20 is extrusion head 25. As the wax-binder mixture reaches the end of the screw 24 it is forced out of extrusion head 25 to form extrudate 26. Such extrudate 26 may have the dimensions of a single body 11 of the device 10, or it may have some multiple of a dimensions thereof. In the latter case the extrudate would subsequently be cut down to the proper size.

Attachment of the lighting means might be accomplished as follows. Lighter material 30 is taken from a roll and passed through wax impregnating means 31, wherein it is thoroughly coated with melted wax. Alternately, a prewaxed material may be used, or a non-wax impregnated lighter, in which case means 31 would be eliminated. Referring now to FIG. 3, lighter material 30 is brought into contact with extrudate 26 and passed under roller 32, which roller presses the lighter material against the warm extrudate thereby causing the lighter to become fused with the extrudate. Subsequently, the extrudate is cut into individual fire kindling devices by appropriate means, such as cutting and trimming knives 33 and 34. However, other means, inclusive of adhesives, may be used to attach the lighting means to the wax-binder component of the product embodied herein.

Figure 4:
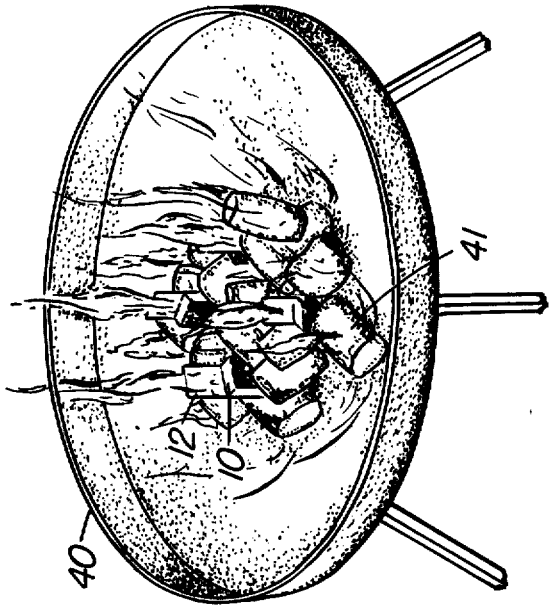
FIG. 4 is a perspective view showing the device of this invention as it might be used to kindle a cooking fire of charcoal briquettes.

FIG. 4 illustrates a preferred method of using the fire kindling device as embodied herein. Charcoal briquettes 41 are placed in a pile in the center of grill 40. Several of the individual devices 10 are positioned in the pile of briquettes such that they are between and/or on top of the briquettes with their lighting means protruding. The lighting means are ignited with an ordinary match or other means and they thereupon transmit the flame to the wax in the body of the kindling device. It is important that the flame be sufficiently hot to raise the temperature of the briquettes to above 200° C. (400° F.), but not so high that the wax on the inside of the device melts before the briquettes are hot. When the wax does melt, the combination of wax and binder taught herein permits a limited amount of the liquid wax to penetrate the hot briquette, while retaining the major portion of the wax in place and thus preventing it from running over the briquettes and dropping to the bottom of the grill. The device must be such that it will continue to burn in the manner described for, desirably, at least 10 minutes in order to ignite hard-to-start briquettes, although other materials may be easier to light and hence require shorter kindling times. The amount of time a fire kindling device, constructed after the manner disclosed herein, will burn and the temperature at which it will burn may be adjusted by varying (1) the composition of the wax, (2) the wax-binder ratio, (3) the size of the device, or (4) by some combination of these factors.

Example

Melted 70 gms. of paraffin wax, melting point 60° C., and mixed with 30 gms. of sawdust. The mixture was poured into a flat, rectangular tray to a depth of 1.4 cm and allowed to cool. Upon cooling the wax-sawdust combination was cut into pieces measuring approximately 3.8 cm by 2.5 cm by 1.4 cm. A piece of absorbent paper, commonly designated as paper towelling, was thoroughly saturated with the same paraffin wax, cut into strips measuring 2.5 cm by 5.7 cm and, while the wax was still in a softened state, pressed onto one side of the shaped wax-sawdust combination to form a lighter which extended 1.9 cm beyond the edge of the body. The device weighed approximately 13 gms. and, when ignited, burned for approximately 13 minutes, which was sufficient to raise hard-to-start charcoal briquettes to an ignition temperature of approximately 260° C.

While preferred embodiements of the novel smokeless fire kindling device of the present invention, and the method for their preparation, have been described for the purpose of illustration, it will be understood that various modifications and adaptations thereof, which will be obvious to those skilled in the art, may be made without departing from the spirit of the invention.

I claim:

1. A device, useful for the kindling of fires, comprising:

(a) a normally solid, shaped composition comprising wax in admixture with a particulate combustible cellulosic material, said admixture comprising the wax in major amount based on the weight of the admixture; and (b) an integral lighting means of combustible sheet material attached to only a portion of the surface area of said composition.

2. A method for kindling a fire in a combustible material, comprising:

a. positioning a shaped solid composition on top of said combustible material, said shaped solid composition comprising an intimate mixture of in excess of 50 percent by weight and up to 90 percent by weight of wax and from 10 percent by weight to less than 50 percent by weight of cellulosic material, based on the total weight of wax and cellulosic material in said composition, said composition further comprising a lighting means of flammable sheet material attached to only a portion of the surface thereof;

b. igniting said shaped solid composition by contacting said lighting means with a flame, which flame is conveyed by said lighting means to the body of said composition, thereupon igniting said wax and cellulosic material;

c. allowing a controlled portion of said wax in the burning composition to melt and permeate said combustible material while the remainder of said wax is held substantially where it was positioned by means of said cellulosic material functioning as a binder for said wax to prevent the entire composition from melting and flowing off of said combustible material; and d. raising the temperature of said combustible material to its ignition point by the continued burning of said shaped composition and of said wax which has melted and permeated said combustible material.

3. The method of claim 2 wherein said combustible material comprises charcoal briquettes.

4. The method of claim 2 wherein said combustible material comprises wood.

5. The method of claim 2 wherein said combustible material comprises natural or artificial fireplace logs.

6. The method of claim 2 wherein said wax comprises from in excess of 50 percent by weight and up to 80 percent by weight of said intimate mixture, while said cellulosic material comprises from 20 percent by weight to less than 50 percent by weight of said mixture.

7. The method of claim 2 wherein said cellulosic material comprises sawdust.

8. The method of claim 2 wherein said lighting means comprises wax-impregnated paper.

* * * * *